US006766727B2

(12) United States Patent
Krafft et al.

(10) Patent No.: US 6,766,727 B2
(45) Date of Patent: Jul. 27, 2004

(54) RODLESS LINEAR DRIVE

(75) Inventors: Gerhard Krafft, Ostfildern (DE); Rolf Weberruss, Kernen (DE); Thomas Wagner, Remseck (DE)

(73) Assignee: Festo AG & Co., Esslingen (DE)

( * ) Notice: Subject to any disclaimer, the term of this patent is extended or adjusted under 35 U.S.C. 154(b) by 2 days.

(21) Appl. No.: 10/257,733

(22) PCT Filed: Jan. 10, 2002

(86) PCT No.: PCT/EP02/00172

§ 371 (c)(1),
(2), (4) Date: Oct. 15, 2002

(87) PCT Pub. No.: WO02/068827

PCT Pub. Date: Sep. 6, 2002

(65) Prior Publication Data

US 2003/0126984 A1 Jul. 10, 2003

(30) Foreign Application Priority Data

Feb. 28, 2001 (DE) ..... 101 09 479

(51) Int. Cl.[7] ..... F01B 29/00
(52) U.S. Cl. ..... 92/88
(58) Field of Search ..... 92/88

(56) References Cited

U.S. PATENT DOCUMENTS 4,555,980 A 12/1985 Höglund
5,724,880 A * 3/1998 Noda ..... 92/88
6,098,522 A 8/2000 Granberg

FOREIGN PATENT DOCUMENTS

| | | |
|---|---|---|
| EP | 0715083 A2 | 6/1996 |
| EP | 0781930 A1 | 7/1997 |
| EP | 0781931 A1 | 7/1997 |
| EP | 0715083 B1 | 9/2000 |
| GB | 2322685 A | 9/1998 |
| JP | 03004005 | 1/1991 |

* cited by examiner

*Primary Examiner*—Edward K. Look
*Assistant Examiner*—Michael Leslie
(74) *Attorney, Agent, or Firm*—Hoffmann & Baron, LLP

(57) ABSTRACT

A piston-rod-less linear drive (1) whose housing (2) possesses a tube body (3) with housing covers (4) mounted at terminal sides. The tube body (3) is provided with a longitudinal slot (16) which is covered over by an internal and/or outer closure band (28 and 29). For securing the terminal band sections (33 and 34) and securing means (32) are provided, which comprises a support body (35) arranged on the respective terminal band section (33 and 34), such support body (35) projecting laterally past the outline of the closure bands (28 and 29) and bearing independently from the housing cover (4), provided on the same terminal side, on the associated terminal face (7) of the tube body (3).

15 Claims, 5 Drawing Sheets

RODLESS LINEAR DRIVE

This application claims priority from German Application No. 101 09 479.5 filed on Feb. 28, 2001.

FIELD OF THE INVENTION

The invention relates to a piston-rod-less linear drive comprising a housing, which possesses a tube body delimiting a piston receiving space and provided at its ends with housing covers, such tube body being provided at one point on its periphery with a longitudinal slot permitting the passage therethrough of a force transmitting member able to be moved in the longitudinal direction of the slot, and a band arrangement extending along the longitudinal slot for closing the longitudinal slot, such band arrangement being composed of an inner closure band provided at the inner slot opening associated with the piston receiving space and/or of an outer closure band provided at the outer face of the tube body, the respective closure band being secured at its two terminal sections by securing means to the housing.

Such a piston-rod-less linear drive is for example disclosed in the European patent publication 0 715 083 B1.

BACKGROUND OF THE INVENTION

It possesses a housing with a tube body of elongated shape, which delimits a piston receiving space, which is shut off by housing covers mounted on the tube body. The tube body is provided with a longitudinal slot extending along its length, which permits the passage of a force transmitting member moving in the longitudinal direction of the slot, such member being kinematically coupled with a piston able to be moved by fluid power and arranged in the piston receiving space. In order to prevent escape of the actuating fluid necessary for the actuation of the linear drive from the piston receiving space through the longitudinal slot an inner closure band is arranged at the inner slot opening, such inner closure band as a rule being termed a sealing band. Furthermore, at the outer slot opening an outer closure band is provided preventing the ingress of dirt, such outer band being generally in the form of a cover band. The two closure bands are moved clear of the longitudinal slot in the vicinity of the force transmitting member in order to render possible the passage of the same. At their two terminal sections of the bands they are respectively secured to the housing by securing means.

The attachment to the housing of the terminal sections of the closure bands is ensured in the linear drive of the said European patent publication 0 715 083 B1 by means of a clamping part biased at the terminal sections against the tube body. The terminal sections are screwed to such clamping part. In the case of this type of attachment on the basis of frictional engagement only there is the danger of the band arrangement made up of the two closure bands becoming detached from the band making up the band arrangement so that the sealing function is impaired. Moreover, the securing means occupy the terminal sections of the longitudinal slot, something which reduces the available overall length or, respectively, increases the overall length necessary for a desired working stroke.

The U.S. Pat. No. 4,555,980 discloses attachment of the terminal sections of the closure bands on the housing covers mounted terminally on the tube body. This means that the longitudinal slot in the tube body has a greater working length. However, this design does suffer from the disadvantage that the housing covers are only able to be attached and detached if the closure bands are unfixed at the same time, something that impedes handling during manufacture and later servicing operations.

SUMMARY OF THE INVENTION

Accordingly one object of the present invention is to provide a piston-rod-less linear drive in the case of which the attachment of the band arrangement takes place in a manner rendering possible compact dimensions and a simple assembly and disassembly of the linear drive.

In order to attain such aim there is a provision such that the securing means for the one or both band terminal sections of the inner and/or outer closure band comprise a support body arranged on the respective terminal band section, such support body projecting laterally past the outer face of the respective closure band and bearing against the associated terminal face of the tube body independently of the housing cover provided on the same terminal face.

Accordingly the attachment of the respective closure band takes place clear of the longitudinal slot and in a manner independent of the housing covers. The available working length of the longitudinal slot formed in the tube body is accordingly not reduced by the securing means and as a rule no extra machining of the tube body is required to produce the securing means. The cover mounted on the respective terminal side may be mounted and dismounted without taking off the band securing means, something which more particularly means a simplification of repairs servicing operations.

Further advantageous developments of the invention are defined in the dependent claims.

In principle it would be possible to utilize the securing means in accordance with the invention both in the case of linear drives provided with only one closure band and also in the case of linear drives having two closure bands on only one end of the tube body and to have a conventional securing means at the opposite end. A design is however particularly advantageous in the case of which the respective closure band is secured at both terminal band sections in the manner in accordance with the invention.

If the linear drive possesses a plurality of closure bands, there is then the possibility of securing same in each case by means of individual support bodies or by means of a common support body on the respective terminal face of the tube body. The separate design facilitates replacement when there is a defect, because the closure band which is not defective may remain in place. The common attachment on one and the same support body more particularly renders possible more rational production and more especially is useful when the support body has to perform other tasks as well.

Such a further task may for example be supporting components or an end-of-stroke damping means, with which the linear drive is fitted. A centering function is advantageously possible as well, if the support body is provided with a centering section, which plunges with a close fit into the opening, provided on the respective terminal face, in the piston receiving space.

The securing means do not interfere with any planned mounting of housing covers. A housing cover may accordingly be still directly mounted on the end of the tube body, if it is provided with a recess, into which the components, extending past the tube body at the end, of the band arrangement and out from the support body or bodies may plunge. There is more especially the possibility of having the recess in the form of a well at the mounting face, facing the tube body, of the housing cover so that the securing means are completely covered over.

Although it would in principle be possible to have a screw securing means with an interlocking effect between the terminal sections of the band and the associated support body, it is preferred to have a clamp securing means, in the case of which a transversely extending through hole is then not necessary. This is best ensured by a clamp securing means. The support body may have a socket for each closure band to be held, into which socket the terminal section of the band is inserted, the desired clamping effect being obtained for example by a wall section, deformed after insertion of the terminal band section, of the socket or by a clamping screw acting on the terminal band section and arranged on the support body.

The measures in accordance with the invention are applicable to a every piston-rod-less linear drive, that is to say for example even in the case of an electrical linear drive, there being particular advantages in the case of linear drives operated with fluid power and more particularly compressed air.

The following provides a detailed account of the invention with reference to the accompanying drawings

DETAILED DESCRIPTION OF THE REFERRED EMBODIMENT

Figure 1:
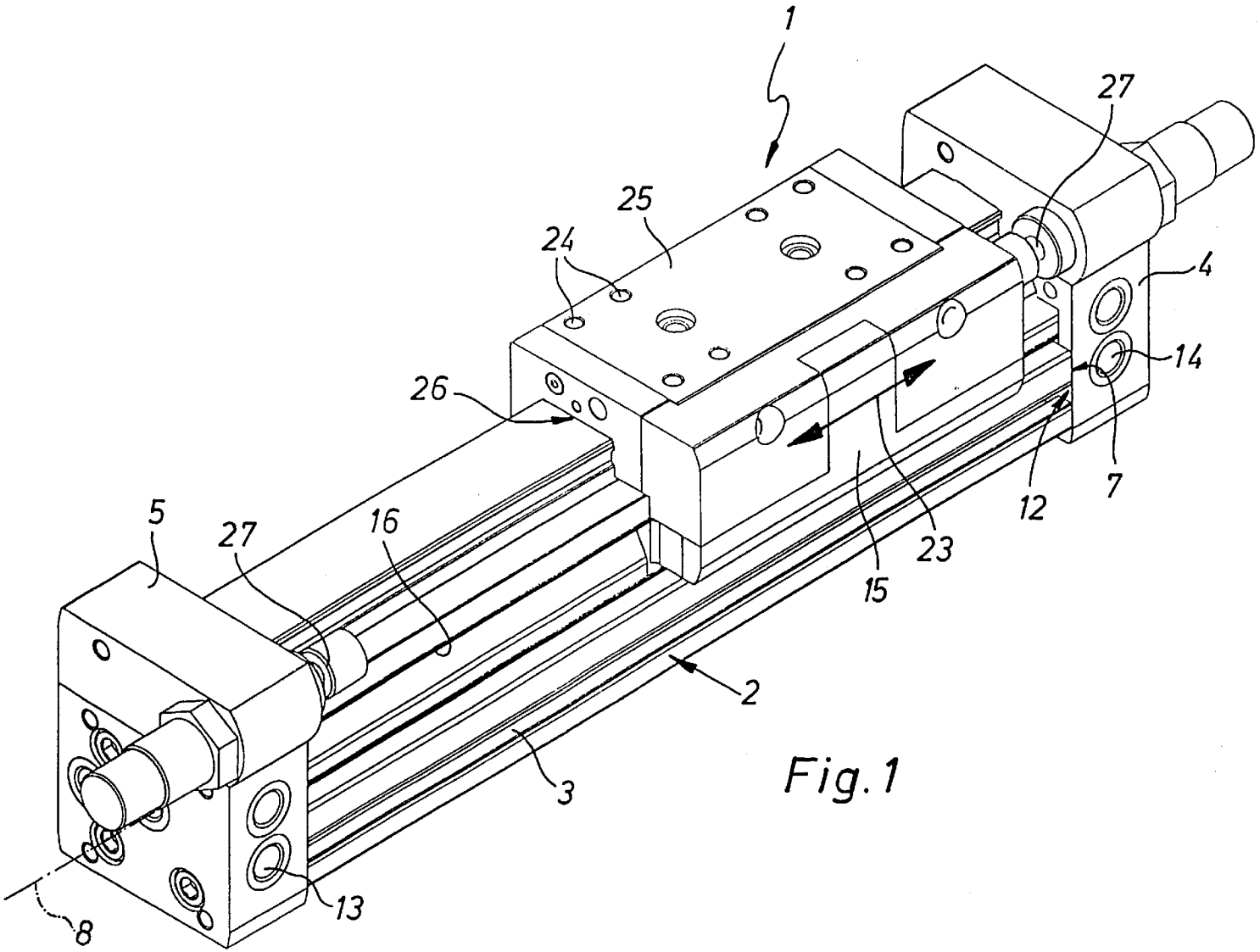
FIG. 1 is a perspective representation of one possible design of the linear drive of the invention.

The piston-rod-less linear drive 1 generally illustrated in FIG. 1 as a whole comprises an elongated housing 2 with a tube body 3 having a complex outline to its cross section, and two housing covers 4 and 5 mounted on the two axially aligned terminal sides or ends of the tube body 3.

The cavity, extending from end to end of the tube body 3 constitutes a piston receiving space 6 having a circular cross section in the embodiment. Other cross sectional forms would be possible, as for example elliptical or oval shapes.

On the ends the tube body 3 possesses a respective, preferably even terminal face 7 which extends perpendicularly to the longitudinal axis 8 of the tube body or, respectively, of the housing 2. On the side facing the tube body 3 the housing covers 4 and 5 have a mounting face 12 at which they rest against the associated terminal face 7 of the tube body 3. For the attachment the housing covers 4 and 5 may be screwed to the tube body 3 for example. Furthermore, attachment by means of ties placed between the housing cover 4 and 5 would be possible.

In the interior of the piston receiving space 6 there is a piston, not illustrated in detail in the figure, which divides up the piston receiving space 6 in a sealing manner into two working spaces. Each working space communicates with a fluid duct 13 and 14, which leads off to the outside and for example opens at an outer face of a housing cover 4 and 5. Here there is the possibility of connecting up fluid lines, by way of which the actuating fluid necessary for the operation of the linear drive 1 may be supplied and removed. In the case of working example it is a question of a fluid power operated linear drive, which is run on compressed air. Hydraulic operation would also be conceivable.

By controlled fluid action in the working spaces it is possible for the piston to be caused to perform a linear movement in the longitudinal direction of the piston receiving space 6. This linear movement is performed as well by a force transmitting member 15, which is coupled with the piston kinematically and extends at the longitudinal face from the tube body 3. The force transmitting member 15 in this case extends through a longitudinal slot 16, which extends at one point on the periphery of the piston receiving space 6 along the full length of the tube body 3 radially. The longitudinal slot 16 accordingly has an inner slot opening 17 open toward the piston receiving space 6 and an outer slot opening 18 open at the longitudinal outer face 19 of the tube body 3.

That portion of the force transmitting member 15 extends from its axial position through the longitudinal slot toward the outside, free of pressure owing to a suitable design of the piston. The length section placed axially on either side of the piston and the force transmitting member 15, of the longitudinal slot 16, which extend along the working spaces, are shut off by a flexible, strip-like band arrangement 22.

The linear movement, due to controlled fluid supply to the working spaces, of the force transmitting member 15—the direction of motion is indicated by a double arrow 23—may be transmitted at the outer periphery of the tube body 3 from the force transmitting member 15 in order to move any desired object in the desired fashion. In the working embodiment illustrated there is a provision such that the transmission of force takes place by way of a carriage body 25 fitted with suitable securing means 24, such body 25 being kinematically coupled in an axially play-free manner with the force transmitting member 15 and is guided for adjustment by a linear guide means 26 externally on the tube body 3 in the direction 23 of movement. The linear guide means 26 can take up transverse forces so that the respective loads are kept clear of the force transmitting member 15 and of the piston coupled with it.

In case of need shock absorbers 27 may be placed on the housing covers 4 and 5 in the stroke of the carriage body 25 to damp the impact thereof, when it draws close to the end of the stroke.

In the working embodiment illustrated band arrangement 22 comprises an inner closure band 28 for the inner slot opening 17 and an outer closure band 29 for the outer slot opening 18. The inner closure band 28 serves to seal off the piston receiving space 6 from the surroundings hermetically, for which purpose it is biased in a direction away from the piston receiving space 6 against the slot walls flanking the longitudinal slot 16 on either side thereof so as to cover over the inner slot opening. The inner closure band 28 may here at least partially fit into the longitudinal slot 16. At the force transmitting member 15 the inner closure band 15 the is moved clear of the longitudinal slot in a conventional manner by a guide means arranged on the force transmitting member and/or the piston in order to permit access of the force transmitting member 15 through the longitudinal slot 16. Owing to its sealing function the inner closure band 28 may also be termed a sealing band.

The outer closure band 28 serves mostly for the purpose of preventing the ingress of dirt from the surroundings of the linear drive 1 into the longitudinal slot 16. It covers the longitudinal slot 16 at the outer slot opening but it is also moved clear of the longitudinal slot 16 at the force transmitting member 15 in order to permit access of the force transmitting member 15 through the slot. The outer closure band 29 may be termed a covering band.

Both closure bands 28 and 29 are secured in position in relation to the housing by means of securing means generally referenced 32. In the drawing, FIGS. 2 through 5, only the band terminal sections 33 and 34 and the securing means thereof are illustrated, which are adjacent to one end of the housing 2, the sealing means and the attachment method being however the same at the other, opposite band ends (not illustrated) so that no separate description is necessary.

The terminal attachment of the closure bands 28 and 29 is ensured in the working embodiment using the same principle of attachment, although it would in principle be possible to utilize this principle of the attachment only in the case of one closure band and/or on only one terminal band section of the respective closure band.

In the working embodiment illustrated FIGS. 1 through 4 the securing means 32 comprises a support body 35 arranged for cooperation with both of the terminal band sections 33 and 34 and on such support body 35 the two closure bands 28 and 29 are held axially clear of the tube body 3, such support body 35 projecting past the outline of the respective closure band 28 and 29 to the side so that at its support face 39, which faces the tube body 3, it bears against the associated terminal face 7 of the tube body 3.

Figure 5:
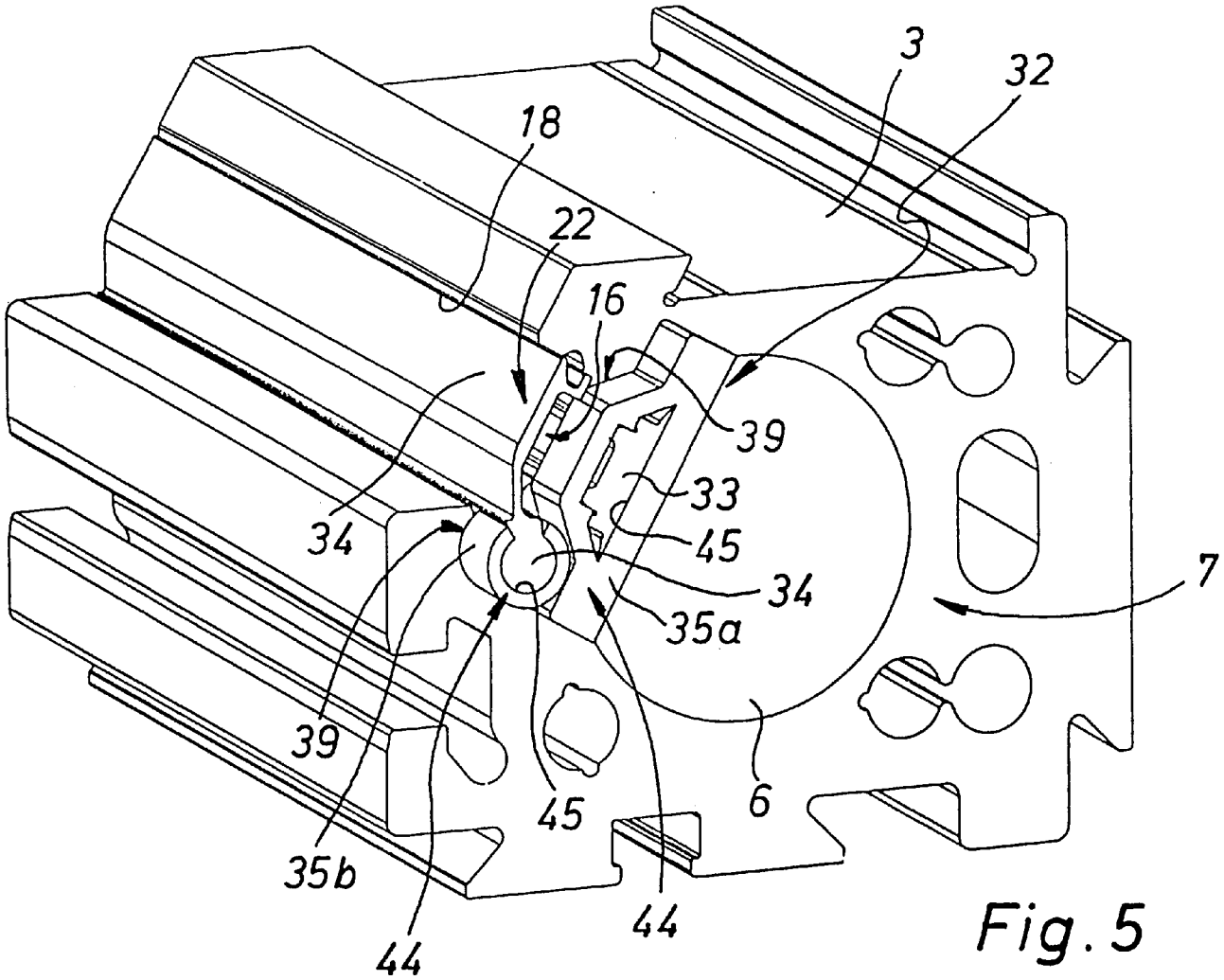
FIG. 5 shows an alternative design of the securing means in a manner of representation the same as in FIG. 2.

In the working embodiment illustrated FIG. 5 each closure band 28 and 29 is provided with its own support body 35*a* and 35*b*, on which the respective terminal band section 33 and 34 is held and which projects past the outline of the associated closure band 28 and 29 so that its support face 39 may bear against the terminal face 7 of the tube body 3.

The terminal band sections 33 and 34 of the closure bands 28 and 29 extend a bit axially past the terminal face 7 in the two working examples of the invention with the result that the support body 34, 35*a* and 35*b* is outside the overall length of the tube body 3. However it would be possible to have a design in the case of which the support body is located within a wider part of the longitudinal slot 16 and bears against a section of the terminal face 7, which assumes a position opposite to the adjacent face sections. The first mentioned and actually illustrated working example does however offer the advantage that the terminal face may be planar and is not in need of any particular machining in order to render possible support of the support body or bodies, respectively, 35, 35*a* and 35*b*.

Figure 2:
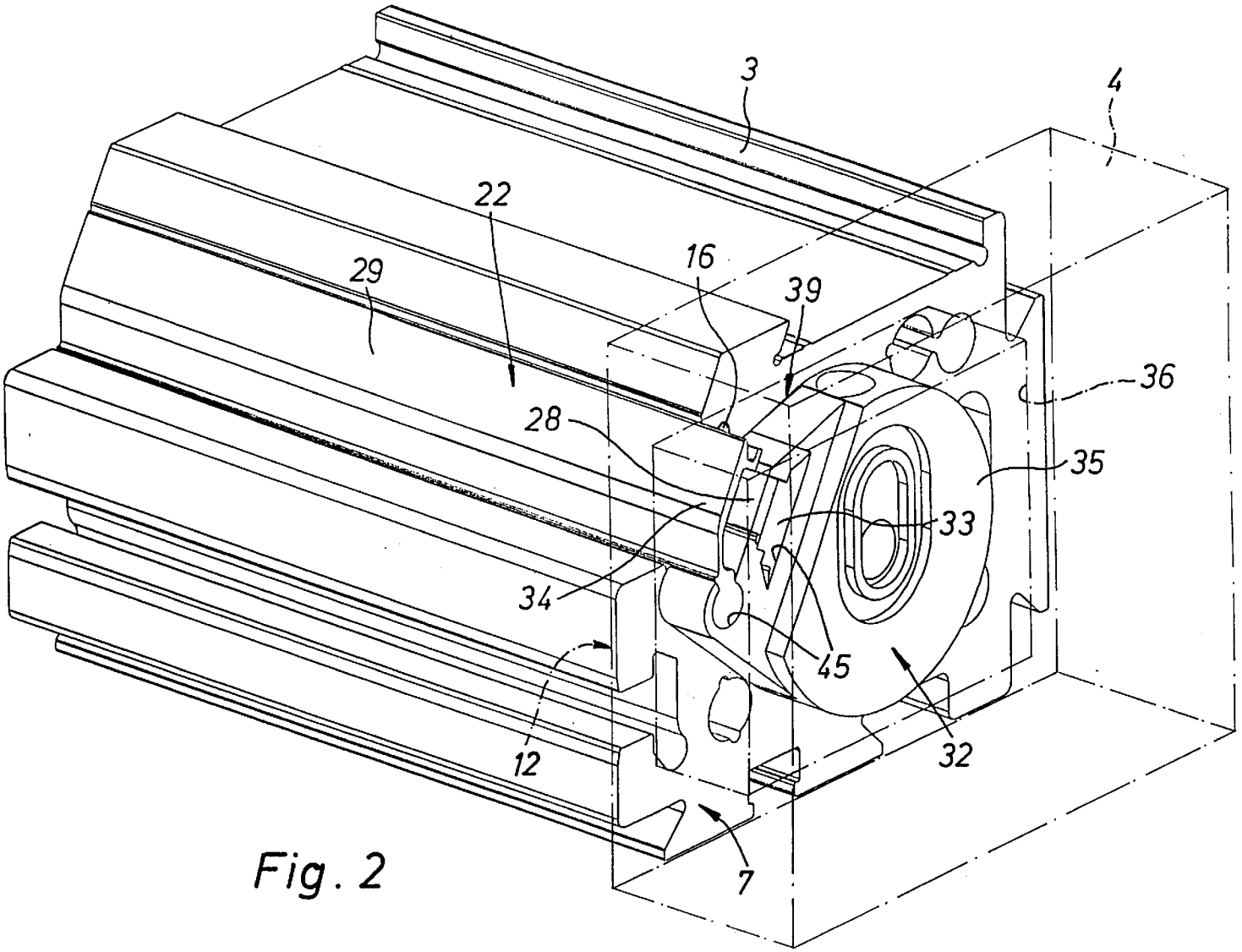
FIG. 2 is an oblique view of the terminal face, illustrated on the right in FIG. 1, of the tube body of the linear drive, which is only illustrated in part, the removed housing cover being indicated in chained lines.
Figure 3:
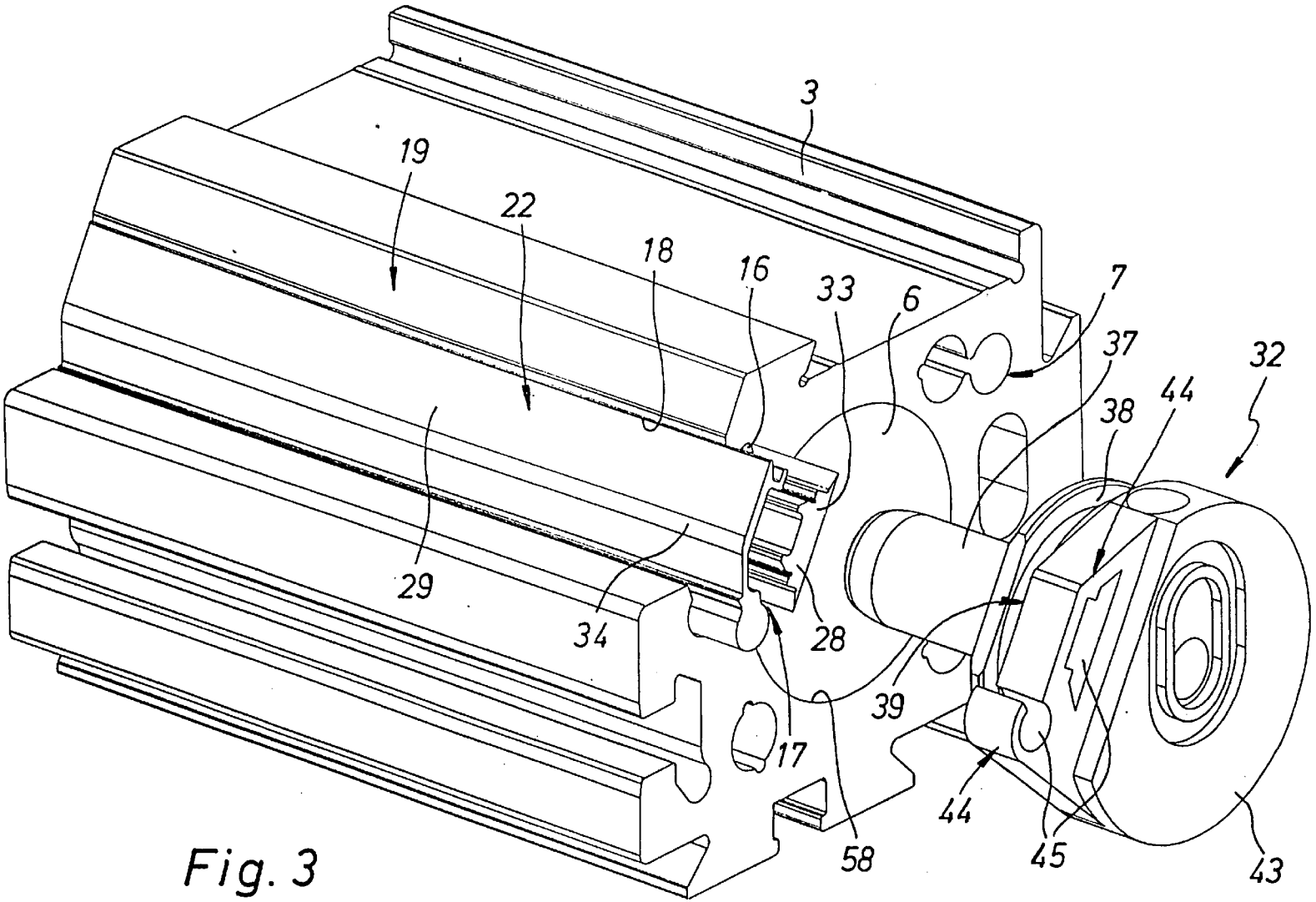
FIG. 3 shows the arrangement in accordance with FIG. 2 illustrating the support body prior to fitting to the band arrangement.
Figure 4:
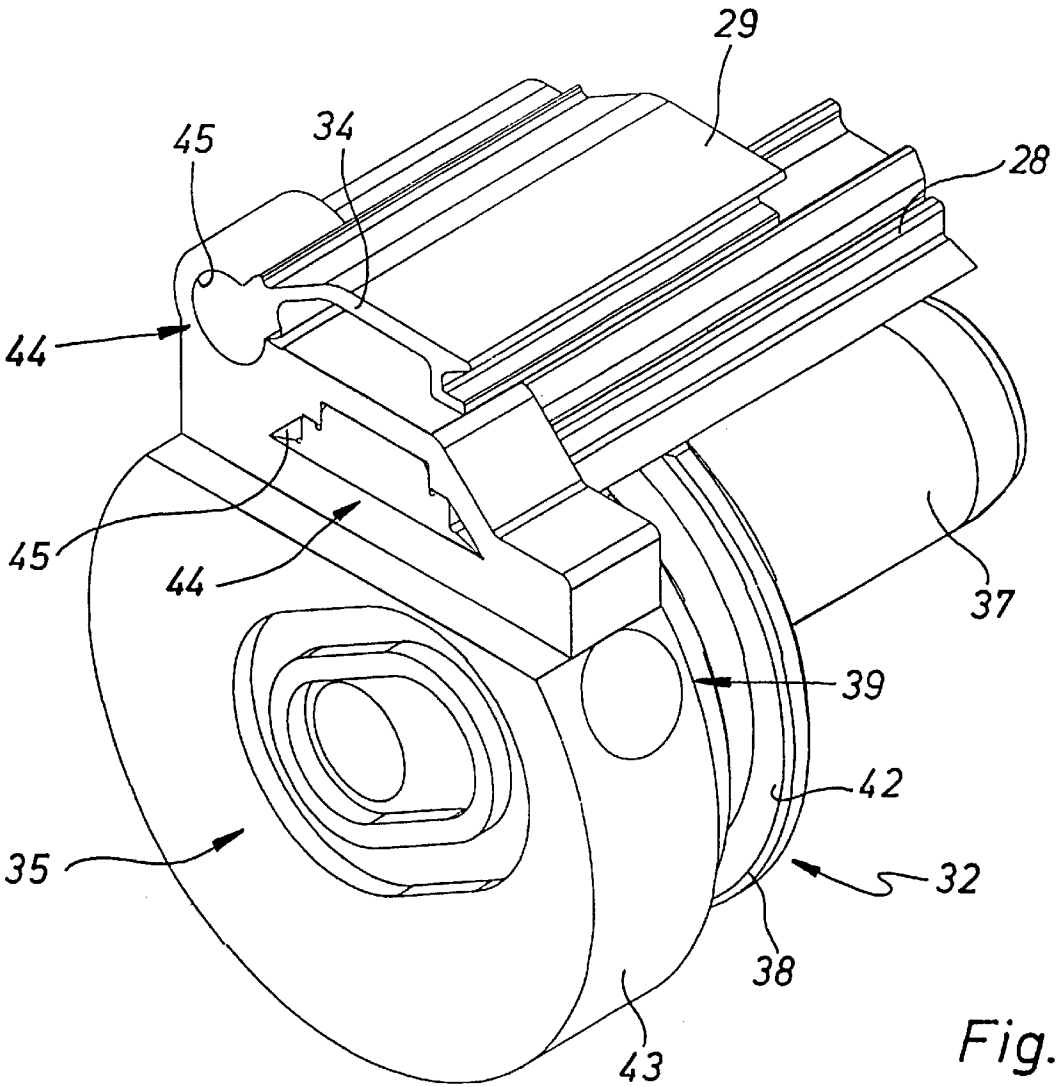
FIG. 4 shows the support body employed in the linear drive of FIGS. 1 through 3 in a separate view and with the band arrangement clamped in place.

In the working embodiment illustrated in FIG. 2 the respective support body 35, 35*a* and 35*b* is placed axially between the tube body 3 and the housing cover 4 bearing against the same terminal face 7. Independently of the housing cover 35, 35*a* and 35*b*, the housing cover 4 in this case bears against the terminal face 7 and does not provide any contribution to securing the band. This means that the housing cover may be mounted and dismounted just as desired without affecting the band arrangement 22.

In this connection the respective housing cover 4—the same applying for the opposite other housing cover 5—is provided with a recess 36 indicated in chained lines, into which the support body 35, 35*a* and 35*b* may fit including the terminal band section 33 and 34 held by it. Dependent on the particular design of the housing cover 4 and 5 the recess may certainly extend through the housing cover 4 and 5 axially and/or be open toward the lateral edge of the housing cover 4 and 5. However it is preferred to adopt the design depicted in FIG. 2, in the case of which the recess 36 is constituted by a pocket-like well in the housing cover 4 and 5 on the mounting face 12 turned toward the tube body 3, such well completely receiving the support body 35, 35*a* and 35*b*, when the housing cover 4 and 5 is mounted, and so surrounding the support body that it is covered over or screened off from the outside.

It would also be readily possible in the case of a design having two separate support bodies 35*a* and 35*b* to provide each support body with its own recess, even although one recess simultaneously receiving both support bodies 35*a* and 35*b* is as a rule more economic to produce.

In the working embodiment illustrated in FIGS. 1 through 4 the support body 35 serving simultaneously for holding both terminal band sections 33 and 34 associated with same terminal side of a tube body has an additional function besides supporting and holding, that is to say as a component of a terminal position damping means. It possesses a preferably essentially cylindrically designed axial projection 37, which in the interior is hollow, which fits coaxially into the piston receiving space 6. Owing to this axial projection 37 there will be a supply and removal of the drive fluid during normal operation of the linear drive.

On the side facing the axial projection 37 the piston is provided with a complementary well, into which the axial projection 37 fits or plunges when the piston draws close to the terminal position. This means that the escape of the drive fluid through the axial projection 37 will be prevented and the medium can now leave, opposed by a choking action, by way of a bypass duct, which is not illustrated. The result of this is a braked movement of the piston toward the respective terminal position.

The support body 35 furthermore has a centering or steadying section 38 which fits into the opening, provided on the terminal face of the piston receiving space 6 and accordingly is guided in a direction athwart the longitudinal axis 8 of the tube body 3. In this respect the centering section 38 preferably bears an annular seal, not illustrated in detail, held in a radially outwardly open annular groove 42 in the centering section 38 the which in the inserted condition in the piston receiving space 6 of the centering 38 makes sealing contact with the inner face of the piston receiving space 6 all the way round. This means that loss of fluid from the piston receiving space 6 between the support body 35 and the tube body 3 is prevented.

The support body 35 furthermore has a tabular or disk-like terminal section 43, on whose one terminal side the centering section 38 and the axial projection 37 are provided and whose transverse dimensions are larger than those of the piston receiving space 6. Accordingly the terminal section 43 of the support body 35 may be guided around the opening 58 of the piston receiving space 6 on the terminal or end face 7 of the tube body 3. The terminal section 43 is accordingly located outside the tube body 3, whereas the other components of the support body 35 extend into the piston receiving space 6.

In the case of the use of a suitable band material, as for example steel, it would be possible for the support body, serving of securing the respective terminal band section 33 and 34, to be guided at least on one terminal band section of the respective closure band 38 and 29 as an integral component of the closure band, for instance by suitably bending over the closure band. However, it is preferred to have a design of the support body which is independent from the closure bands, something offering the advantage that no special measures are needed for securing and furthermore closure bands may be utilized which partially or completely consist of plastic material or rubber.

Such a design is provided in the working examples, where the support body 35, 35*a* and 35*b* is fitted with a securing means 44 for each terminal band section to be held. Since in the working example in accordance with FIGS. 1 through 4 the support body 35 serves for simultaneously holding both closure bands 28 and 29, in this case it is fitted with two means 44, which take effect independently of one another so that each closure band 28 and 29 may be secured independently for the other. The securing means 44 are in this case best mounted at one point on the peripheral edge of the disk-like terminal section 43.

The securing means 44 are so designed that they render possible a clamping holding action for the support body 35, 35*a* and 35*b* on the terminal band section 28 and 29. Accordingly no special-purpose machining of the closure band is required and it is more particularly possible to do without through holes in the terminal band sections.

As regards details the securing means 44 preferably in this connection have a respective socket 45, which preferably extends through the associated support body 35, 35*a* and 35*b* in the axial direction and has such an outline that the terminal band section 33 and 34 to be held may be inserted and in the inserted state is partially or completely surrounded by the wall delimiting the socket 45.

The working examples are two designs, in the case of which the terminal section 33 of the inner closure bands 28 is seated in the socket 45 for the entire periphery, whereas the terminal section 34 of the outer closure band 29 is merely surrounded in part by the wall of the socket 45. The design in this case depends to a great extent on the structure and the manner of operation of the associated closure band 28 and 29.

The terminal band sections 33 and 34 are held in the associated socket 45 by a clamping action, something which is made possible because at least one section of the wall delimiting the socket 45 is so deformed following insertion of the terminal band section 33 and 34 that the terminal band section 33 and 34 is gripped. Additionally or as an alternative securing by means of a clamping screw would be possible.

The band securing means in accordance with the invention may also find employment in linear drives, which only have one closure band or in the case of which one closure band consists a plurality of separate band elements. Furthermore, use is not limited to fluid operated linear drives, and is for example suitable for electrical linear drives, in the case of which a longitudinal covered over.

What is claimed is:

1. A piston-rod-less linear drive comprising:

a housing, which possesses a tube body delimiting a piston receiving space and provided at its ends with housing covers, such tube body being provided at one point on its periphery with a longitudinal slot permitting the passage therethrough of a force transmitting member able to be moved in the longitudinal direction of the slot, and a band arrangement extending along the longitudinal slot for closing the longitudinal slot, such band arrangement including an inner closure band provided at the inner slot opening associated with the piston receiving space and/or of an outer closure band provided at the outer face of the tube body, the respective closure band being secured at its two terminal sections by securing means to the housing, characterized in that the securing means for the one or both band terminal sections of the inner and/or outer closure band comprise a support body arranged on the respective terminal band section, such support body projecting laterally past the outer face of the respective closure band and bearing against the associated terminal face of the tube body independently of the housing cover provided on the same terminal face wherein the terminal band section of the inner and/or outer closure band extend axially beyond the terminal face of the tube body into a socket disposed on the support body and are held therein by a clamping action.

2. The linear drive as set forth in claim 1, characterized in that in the case of the presence of the inner and the outer closure band the terminal band sections associated with the same terminal side of the tube body bear by the intermediary of a common support body on the terminal face of the tube body.

3. The linear drive as set forth in claim 1, characterized in that in the case of the presence of the inner and the outer closure band terminal band sections associated with the same terminal side of the tube body bear by the intermediary of separate support bodies on the terminal face of the tube body.

4. The linear drive as set forth in claim 1, characterized in that on at least one terminal side of the tube body the support body is provided guided around the opening, provided on this terminal side, of the piston receiving space on the terminal face of the tube body.

5. The linear drive as set forth in claim 1, characterized in that on at least one terminal side of the tube body a support body is provided having a centering section fitting into the opening, provided on such terminal side, of the piston receiving space.

6. The linear drive as set forth in claim 5, characterized in that the support body has an axial projection, forming part of an end-of-stroke damping means, for fitting into the piston receiving space.

7. The linear drive as set forth in claim 1, characterized in that the support body engages a planar terminal side of the tube body axially clear of the tube body.

8. The linear drive as set forth in claim 1, characterized in that the support body or bodies provided on one terminal side of the tube body fit into a recess in the housing cover mounted on the same terminal side.

9. The linear drive as set forth in claim 8, characterized in that the recess is formed by a well on the mounting face of the housing cover.

10. The linear drive as set forth in claim 1, characterized in that the support body or bodies provided on one terminal side of the tube body are completely surrounded and covered over by the mounted housing cover.

11. The linear drive as set forth in claim 1, characterized by a clamping attachment of the support body on the terminal section of the closure band to be held.

12. The linear drive as set forth in claim 1, characterized in that such clamping action is caused by a wall section of the socket deformed following insertion of the terminal band section and/or by a clamping screw arranged on the support body.

13. The linear drive as set forth in claim 1, characterized in that the force transmitting member is kinematically coupled with an axially moving piston arranged in the piston receiving space.

14. The linear drive as set forth in claim 1, characterized by a design thereof for fluid power and more especially for pneumatic operation.

15. A piston-rod-less linear drive comprising:

a housing, which possesses a tube body delimiting a piston receiving space and provided at its ends with housing covers, the tube body being provided at one point on its periphery with a longitudinal slot permitting the passage therethrough of a force transmitting member able to be moved in the longitudinal direction of the slot, and a band arrangement extending along the longitudinal slot for closing the longitudinal slot, the band arrangement being composed of an inner closure band provided at the inner slot opening associated with the piston receiving space and of an outer closure band provided at the outer face of the tube body, the respective closure band being secured at its two terminal sections by securing means to the housing, wherein the securing means for the one or both band terminal sections of the inner and/or outer closure band includes a support body arranged on the respective terminal band section, such support body projecting laterally past the outer face of the respective closure band and bearing against the associated terminal face of the tube body independently of the housing cover provided on the same terminal face, and wherein the inner and an outer closure band terminal band sections associated with the same terminal side of the tube body bear by the intermediary of separate support bodies on the terminal face of the tube body.

* * * * *